US006632333B1

(12) United States Patent
Eriksson et al.

(10) Patent No.: US 6,632,333 B1
(45) Date of Patent: Oct. 14, 2003

(54) DEVICE FOR SEPARATING METAL DEPOSIT FROM A CATHODE

(75) Inventors: Ola Eriksson, Deje (SE); Revill Wayne Armstrong, Townsville (AU); Kei Shibata, Tokyo (JP); Yasuo Suga, Tokyo (JP); Jan Anders Haag, Lithia Springs, GA (US); Ronald Lee Pariani, Smyrna, GA (US); David Bailey, Townsville (AU)

(73) Assignee: Outokumpu Oyj, Espoo (FI)

( * ) Notice: Subject to any disclaimer, the term of this patent is extended or adjusted under 35 U.S.C. 154(b) by 0 days.

(21) Appl. No.: 09/856,102

(22) PCT Filed: Nov. 26, 1999

(86) PCT No.: PCT/FI99/00979

§ 371 (c)(1),
(2), (4) Date: Sep. 20, 2001

(87) PCT Pub. No.: WO00/32846

PCT Pub. Date: Jun. 8, 2000

(30) Foreign Application Priority Data

Nov. 27, 1998 (FI) ..... 982569

(51) Int. Cl.[7] ..... C25C 7/02; C25C 7/08

(52) U.S. Cl. ..... 204/227; 204/280; 204/DIG. 7; 205/717

(58) Field of Search ..... 204/227, 280, 204/DIG. 7; 205/152, 717, 560

(56) References Cited

U.S. PATENT DOCUMENTS

| | | | | |
|---|---|---|---|---|
| 3,935,091 A | | 1/1976 | Rautimo et al. | |
| 4,045,301 A | | 8/1977 | Wens et al. | |
| 4,417,953 A | | 11/1983 | Viellefont et al. | |
| 4,447,307 A | * | 5/1984 | Davis et al. | 204/267 |
| 4,840,710 A | | 6/1989 | Middlin et al. | |

FOREIGN PATENT DOCUMENTS

| | | |
|---|---|---|
| DE | 140624 | 3/1980 |

* cited by examiner

*Primary Examiner*—Roy King
*Assistant Examiner*—Harry D. Wilkins, III
(74) *Attorney, Agent, or Firm*—Smith-Hill and Bedell

(57) ABSTRACT

The invention relates to a device for separating metal deposit from a mother plate used as a cathode in an electrolytic process, as metal electrorefining or metal electrowinning, in which device there is a supporting member for supporting the cathode to be treated, a member for releasing at least partly a metal deposit grown during the electrolytic process on a surface of the mother, and a member for support the released metal deposit. According to the invention the mother plate of a cathode (1, 21, 31, 41, 51) is provided with a growth affecting means (16, 24, 36, 43, 53) for creating an irregularity in the growth of the metal deposit (4) to be used as a hinged member when the metal deposit (4) is tilted to the mother plate of the cathode (1, 21, 31, 41, 51) in order to break the metal deposit (4) in two separate pieces along the irregularity in the growth.

10 Claims, 3 Drawing Sheets

DEVICE FOR SEPARATING METAL DEPOSIT FROM A CATHODE

Figure 1:
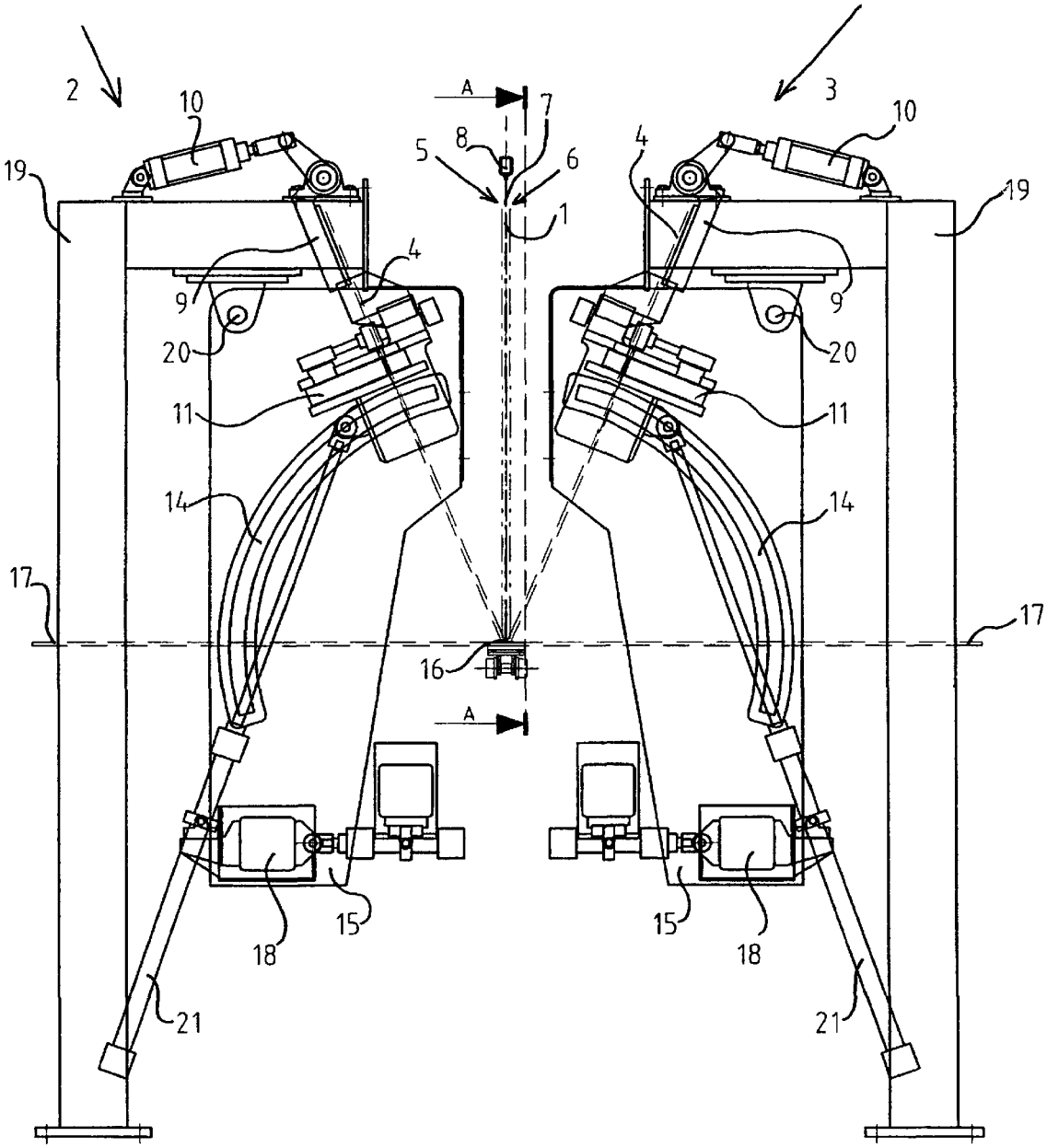

The invention relates to a device for separating metal deposit from a mother plate used as a cathode in the electrolytic process, as metal electrorefining or metal electrowinning.

The refining of many metals, such as copper, zinc and nickel, includes electrolytic process where harmful impurities are separated from the metal to be produced. The metal produced in the electrolytic process is gathered on the cathode by means of electric current. Usually the electrolytic process is carried out in tanks filled with an electrolyte containing sulphuric acid and, immersed therein, a number of plate-like anodes and cathodes made of some electro conductive material and placed in an alternating fashion. At the top edges, the anodes and cathodes are provided with lugs or bars for suspending them at the tank edges and for connecting them to the power circuit. The metal to be produced is brought into the electrolytic process either as soluble anodes in electrorefining process, or as dissolved in the electrolyte at some preceding process stage, in which case the employed anodes are insoluble in electrowinning process.

The cathode used in the electrolytic process can be produced of the desired metal to be produced, in which case the deposit need not be stripped from the original cathode plate. Usually, however, the cathode, i.e. the mother plate, to be immersed in the electrolytic tank is made of some other metal than the one to be produced. Such materials of the mother plate can be for instance stainless steel, aluminium or titanium. In that case the metal to be produced is gathered on the surface of the mother plate in deposits, which are removed from the mother plate at defined intervals.

Owing to electric current, the metal produced in the electrolytic process is accumulated in deposits on all electro conductive surfaces of the mother plate, i.e. if the mother plate is completely electro conductive, the metal to be produced covers in a uniform deposit the mother plate in all parts immersed in the electrolyte. In order to facilitate the removal of the deposits of the metal to be produced from the surfaces of the mother plate, it is necessary to affect the metal to be produced from accumulating deposits over the narrow edges of the mother plate, i.e. the edges of the mother plate must be made non-conductive.

The best-known way to make the edges of the mother plate non-conductive is to cover the edges with edge strips made of some insulating material, such as plastic. Generally the insulating strips are plastic profiles with a groove-shaped cross-section and are pressed onto the edges of the mother plate and remain in place either owing to the pressure created by the transformation, by rivets inserted through the mother plate or due to a combination of these. When the deposits are removed from the mother plate by stripping, it is possible that the edge strip positioned on the edge opposite to the edge where the hanger bar is installed will be damaged if there is no protection over the strip. Therefore, instead of a plastic edge strip on the edge opposite to the edge where the hanger bar is installed wax is used as a non-conductive material in order to produce two separate deposits, or the deposits are allowed to grow uniformly around the bottom of the mother plate producing a single deposit. The problem with wax is that it has to be washed off from the mother plate and from the deposits prior to the separation of the deposits and then re-applied on the mother plate after the separation, and that some wax may still be in the deposits after washing causing some contamination of the produced metal. The problem with the single deposit is that it is much more complicated to handle the deposit during the separation of the deposit from the mother plate and that the single deposit is not well suited for some end use applications.

The object of the present invention is to eliminate some of the drawbacks of the prior art and to achieve a new and viable device for separating the metal deposits created in the electrolytic process from the mother plate by affecting at least partly the growth of the deposit on the edge or on the vicinity of the edge of the mother plate opposite to the edge where the hanger bar is installed. The essential novel features of the invention are apparent from the appended claims.

According to the invention the cathode to be treated in the device of the invention contains a plate-like mother plate and a hanger bar which is installed on one edge of the mother plate. The mother plate of the cathode is provided on the edge or on the vicinity of the edge opposite to the edge where the hanger bar is installed with a means for preventing partly the growth of the metal deposit. The growth affecting means is advantageously for instance a groove in the edge or in the vicinity of the edge of the mother plate or the mother plate is made longer than the respective anode in the metal electrorefining or metal electrowinning process and the precipitation speed in that additional area is decreased and the growth of the metal deposit is then slower. By using the area where the growth of the metal deposit is at least partly affected, the metal deposit is divided into two separate pieces during or after the removing process of the metal deposit.

The growth affecting means of the invention at least partly prevents an essentially uniform growth of a metal deposit on the surface of the mother plate in order that when the metal deposit is bent, the metal deposit is broken in two parts on the location of the growth affecting means. In one embodiment the change in the growth of the metal deposit is based on that the groove to be used as the growth affecting means is shaped so that the grain structure in the metal deposit is changed and the bending properties on that part of the metal deposit are changed. The growth affecting means is for instance a wedge-shaped groove which walls are in an acute angle to each other so that the groove is at the broadest at the surface of the plate-like part of the mother plate. The groove can be created for instance by machining into the mother plate. The groove can also be created by attaching a metal profile to the mother plate so that the metal profile is one of the walls of the groove and the mother plate itself is the other one.

In a further embodiment a groove is created into the mother plate and this groove is filled in with material which has a poor conductivity. This groove is made so narrow that the metal deposit can grow over the area where the filling material is effecting, but it is not possible for the metal deposit to grow along the surface of the fill material. Thus the metal deposit grows over the surface of the filling material slower than on the surface of the mother plate and the metal deposit is thinner and, therefore, easier to be bent when the metal deposit is under the releasing process.

The growth affecting means creates on the mother plate an irregularity in the growth of the metal deposit which irregularity is advantageously used as a hinged member when the metal deposit created in the electrorefining or electrowinning process on the mother plate is removed from the mother plate with the separating device. When hinging the tilting angle of the metal deposit in relation to the mother plate of the cathode is advantageously between 60 to 150 degrees, preferably essentially 90 degrees. The metal deposit is for instance hinged on the growth affecting means from the surface of the mother plate up to an essentially right-angled position to the mother plate. The metal deposit can also be hinged on the growth affecting means by bringing the metal deposit in an up and down motion.

In the preferred embodiment of the invention the metal deposits from both sides of the cathode are simultaneously treated. However, it is also possible to treat the metal deposits separately. The cathode to be treated is supported in the essentially vertical position. The metal deposits on both sides of the cathode to be treated are first partly released starting from the edge where the hanger bar is installed. These partly released metal deposits are then tilted until the partly released metal deposits have a contact with the supporting members or the gripping member of the device. In this supporting position the metal deposits are gripped with at least one gripping member of the device and these gripping members are used to tilt the metal deposits so that the metal deposits are advantageously finally in an essentially horizontal position. When tilting the metal deposits to the essentially horizontal position the metal deposits are in at least partial contact with the mother plate of the cathode. During this tilting stage the growth affecting means of the mother plate is used as a hinged member so that the metal deposits are tilted around the area where the growth is affected by this growth affecting means.

In order to produce two separate pieces from one metal deposit in one embodiment of the invention, the essentially horizontal metal deposit with the gripping members is moved to the separation position and is broken along the growth affected area by pulling its ends into opposite directions by the gripping members. When the separation is completed, the gripping members release the metal deposits and the gripping members are returned for the treatment of metal deposits of a new cathode. The separation of the metal deposit into two separate parts can also be performed so that the breaking is done after the metal deposit has been tilted into a separation position and has released by the gripping members in a separate breaking station. The breaking is thus performed by pulling the ends of the metal deposit into opposite directions or by some other means of separation.

In one embodiment of the invention the metal deposits are completely separated from the mother plate by moving the gripping members in up and down motion in the tilting stage of the metal deposit so that the growth affecting means is used as a hinged member. During this up and down motion the metal deposit is completely separated from the mother plate around the growth affecting means.

In the separating device of the invention the cathode to be treated is supported in an essentially vertical position and the cathode maintains its position essentially during the whole time when the metal deposits are removed. The gripping members which are used for tilting the metal deposits to the essentially horizontal position, are moved along a guide member. The guide member installed on a frame member is pivotable connected to a frame member of the device. In one embodiment the separating member which finally separates the metal deposit from the mother plate, is advantageously installed on the same frame member as the guide member of the gripping members. It is also possible to install the guide member and the separating member so that they have different frame members of their own. The guide member is advantageously so arched that the center of the arc is co-axial with the line connecting the two sides of the metal deposit so that the metal deposits are tilted around the area where the growth is affected. In the essentially position of the metal deposit, the separating device provides a movement of the gripping members opposite directions causing the metal deposit to break along the area where the growth is affected, producing two separate pieces.

In still one embodiment the mother plate of the cathode can be lifted away from the at least partly released metal deposits prior to or during the up and down motion. The Ifting of the mother plate will make more effective the up and down motion of the metal deposits. In that case, it is preferred that the mother plate is supported by the hanger bar during the release of the metal deposits.

For the operation of the device of the invention, the desired movements of the members to be moved in different steps of the operation are created by regulating units which are operated pneumatically, hydraulically or electrically.

Figure 2:
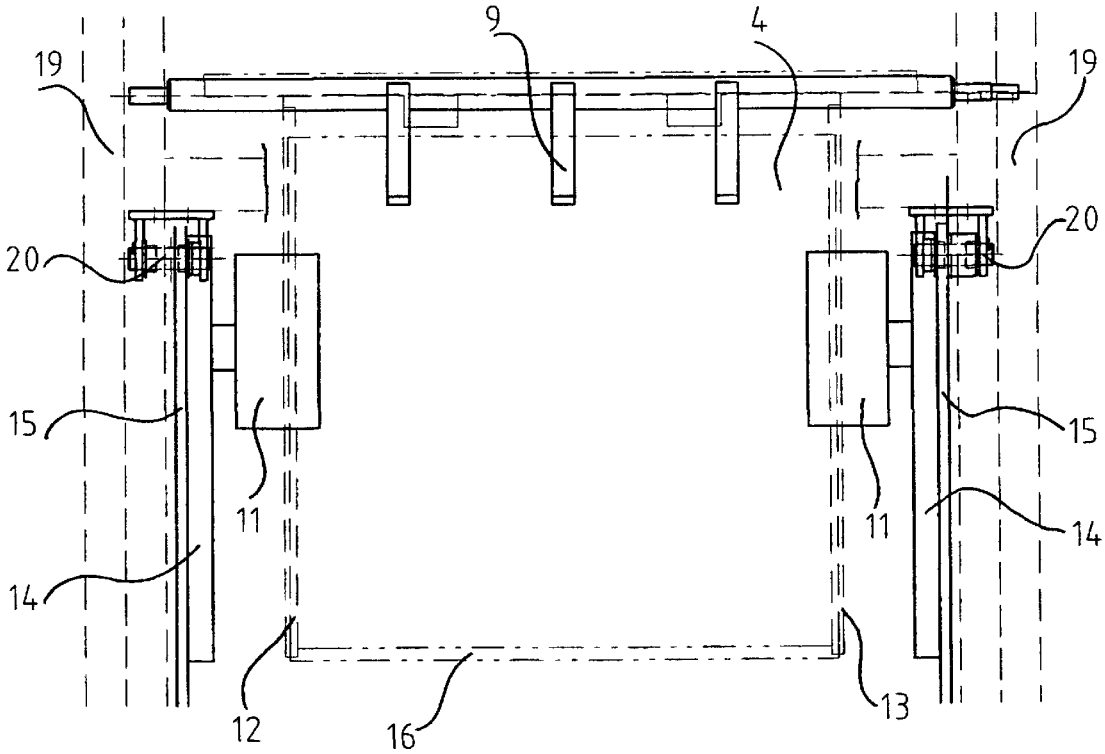
Figure 3:
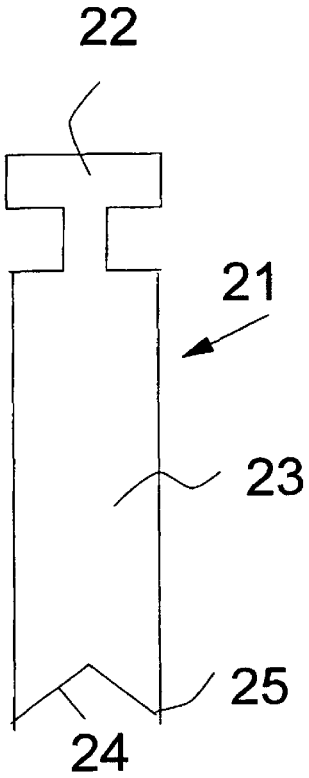
Figure 4:
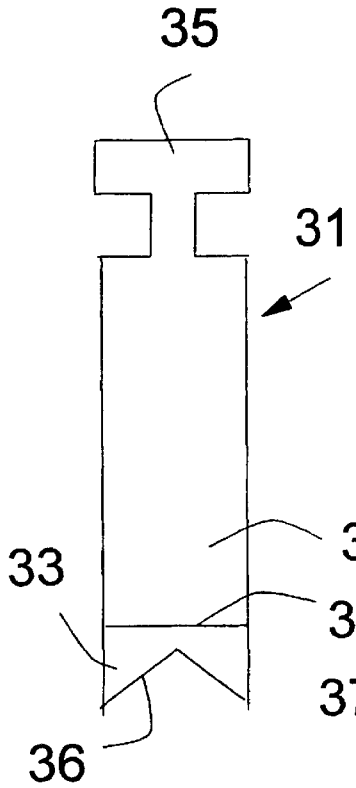
Figure 5:
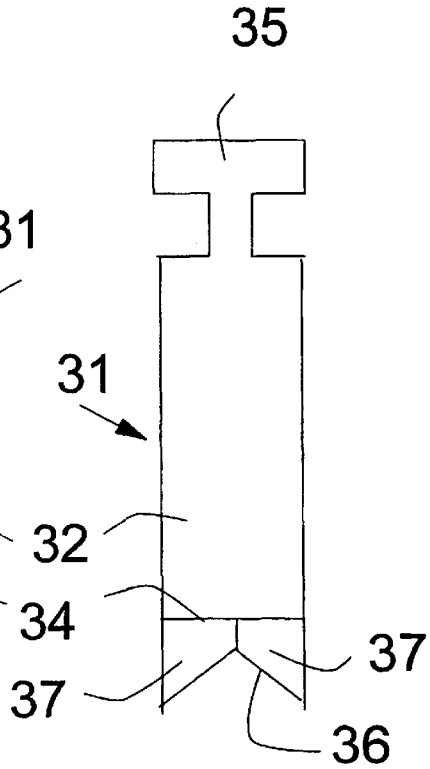
Figure 6:
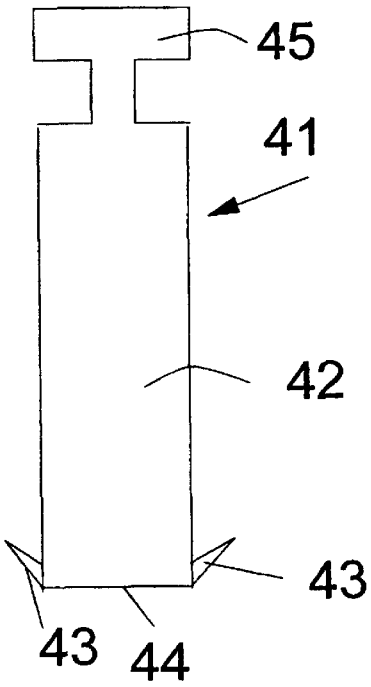
Figure 7:
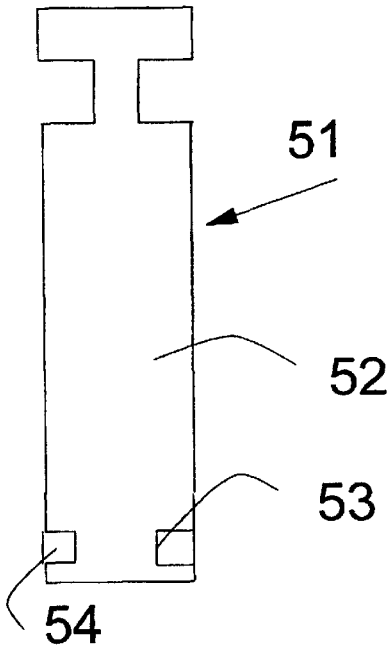

The invention is described in more detail with reference to the appended drawings, wherein FIG. 1 is a schematic side-view illustration of the preferred embodiment of the invention, FIG. 2 is a partial and schematic side-view illustration from the direction A—A of the embodiment in FIG. 1, FIG. 3 is a side-view schematic illustration of an embodiment of a cathode to be used in the device of the invention, FIG. 4 is a side-view schematic illustration of another embodiment of a cathode to be used in the device of the invention, FIG. 5 is a side-view schematic illustration of one another embodiment of a cathode to be used in the device of the invention, FIG. 6 is a side-view schematic illustration of one further embodiment of a cathode to be used in the device of the invention and FIG. 7 is a side-view schematic illustration of still one further embodiment of a cathode to be used in the device of the invention.

According to FIGS. 1 and 2 a cathode 1 to be treated in the device of the invention is positioned between two separate apparatuses 2 and 3 in order that metal deposits 4 from both sides 5 and 6 of the cathode 1 can be treated essentially simultaneously. The metal deposit 4 is first partly, starting from the edge of the mother plate 7 wherein the hanger bar 8 of the mother plate is installed, released from the cathode 1 by a releasing member (not illustrated). By means of this releasing force the metal deposit 4 is tilted to a supporting position illustrated as dotted line. In this supporting position the metal deposit 4 is supported by a supporting member 9 which is movable by a pneumatic cylinder 10. In the supporting position the metal deposit 4 is gripped by gripping members 11 on both essentially parallel edges 12 and 13 of the metal deposit 4 which edges are at least partly released from the mother plate 7.

When the metal deposit 4 is gripped by the gripping members 11 the supporting member 9 is moved from the supporting position to the rest position. The metal deposit 4 is then supported by the gripping members 11, which gripping members 11 are movable installed on a guide member 14. In order to release the metal deposit 4 more and more from the cathode 1 the gripping members 11 as well as the metal deposit 4 are moved along the guide member 14 by means of hydraulic cylinders 21. The guide member 14 is positioned on a frame member 15 so that during the movement of the guide member 14 the metal deposit 4 is simultaneously tilted around a growth affecting means 16 of the cathode 1. The guide member 14 is installed on the frame member 15 so that the distance between the gripping members 11 and the growth affecting means 16 of the cathode is maintained essentially constant from the supporting position created by the supporting member 9 to the essentially horizontal position 17 of the metal deposit 4.

After tilting the metal deposit 4 to an essentially horizontal position 17 by means of the gripping members 11 and the growth affecting means 16, the metal deposit 4 is essentially horizontally moved by a separating member 18 so that the metal deposit 4 is totally released free from the cathode 1. The separating member 18 is installed on the frame member 15. The frame member 15 is pivotably 20 installed to the main frame 19 of the device so that the metal deposit 4 is supported by the gripping members 11 during the separating operation of the separating member 18. After separating the metal deposit 4 from the cathode 1, the gripping members 11 are opened and the metal deposit 4 is transferred to further treatment. The gripping members 11 are returned by the guide member 14 back to receive a new metal deposit for separating.

In the embodiment of the FIGS. 1 and 2 the gripping members 11 can also be worked so that the gripping members 11 are in up and down motion. During this motion the metal deposit 4 is hinged on the growth affecting means 16 and the metal deposit 4 is broken in two parts on the location of the growth preventing 16. Then the gripping members 11 are tilted to the essentially horizontal position 17 and the metal deposit 4 is released and transferred to further treatment.

According to FIG. 3 a hanger bar 22 is attached to a plate-like part 23 of a mother plate 21. A groove 24 with the walls in acute angle to each other is created into the edge 25 of the mother plate 21 opposite to the edge where the hanger bar 22 is attached. The groove 24 affects the growth of a metal deposit (not illustrated) and provides a grain structure that is used as a hinge when the metal deposit is tilted.

In FIG. 4 a plate-like part 32 of a mother plate 31 is provided with a tool 33 which tool 33 is attached to an edge 34 of the plate-like part 32 of the mother plate 31 opposite to the edge where a hanger bar 35 of the mother plate 31 is attached. The tool 33 is on its surfaces essentially convergent with the surface of the plate-like part 32 of the mother plate 31. In the tool 33 there is a groove 36 having the walls in an acute angle with each other and to be used as a growth affecting member.

The embodiment in FIG. 5 is similar to the embodiment of FIG. 4, but instead of that the tool 33 is made of one piece, the tool 37 in FIG. 5 is made of two pieces.

In the embodiment of FIG. 6 a plate-like part 42 of a mother plate 41 is provided with a growth affecting means 43 in the vicinity of an edge 44 of the plate-like part 42 of the mother plate 41 opposite to the edge where a hanger bar 45 of the mother plate 31 is attached. The growth affecting means 43 is attached to the surface of the plate-like part 42 of the mother plate 41 so that one wall of the growth affecting means 43 is in an acute angle with the surface of the plate-like part 42 of the mother plate 41.

According to FIG. 7 a plate-like part 52 of a mother plate 51 is provided with a groove 53 which is filled with an electrically non-conducting material 54. The groove 53 is a growth affecting means over which groove 53 a metal deposit can be grown.

What is claimed is:

1. Device for separating metal deposit from a mother plate used as a cathode in an electrolytic process, as metal electrorefining or metal electrowinning, in which device there is a supporting member for supporting the cathode to be treated, a member for releasing at least partly a metal deposit grown during the electrolytic process on a surface of the mother, the mother plate of a cathode providing with a growth affecting means for creating an irregularity in the growth of the metal deposit, and a member for supporting the released metal deposit, characterised in that a growth affecting means (16,24,36,43,53) for creating an irregularity in the growth of the metal deposit (4) is on the edge or on the vicinity of the edge of the mother plate of the cathode (1,21,31,41,51) a groove with the walls in acute angle to each other so that the groove is the broadest at the surface of the mother plate of the cathode (1,21,31,41,51), and the growth affecting means (16,24,36,43,53) is used as a hinged member when the metal deposit (4) is tilted to the mother plate of the cathode (1,21,31,41,51) in order to break the metal deposit (4) in two separate pieces along the irregularity in the growth.

2. Device according to claim 1, characterized in that a tilting angle of the metal deposit for the separation along the irregularity in the growth of the metal deposit created by the growth affecting means is between 60–150° to the mother plate of the cathode.

3. Device according to claim 1, characterized in that a tilting angle of the metal deposit for the separation along the irregularity in the growth of the metal deposit created by the growth affecting means is essentially 90° to the mother plate of the cathode.

4. Device according to claim 1, characterized in that the metal deposit is brought in an up and down motion for the separation along the irregularity in the growth of the metal deposit created by the growth affecting means.

5. Device according to claim 1, characterized in that for the breaking of the metal deposit into two separate parts along the irregularity in the growth of the metal deposit created by the growth affecting means, gripping members of the metal deposit are moved into opposite directions.

6. Device according to claim 1, characterized in that for the breaking of the metal deposit into two separate parts along the irregularity in the growth of the metal deposit created by the growth affecting means, the metal deposit is transferred to a separate breaking station for pulling the metal deposit into opposite directions.

7. Device according to claim 1, characterized in that mother plate of the cathode is lifted away from the at least partly released metal deposits prior to the up and down motion in order to make more effective the up and down motion of the metal deposits.

8. Device according to claim 1, characterized in that mother plate of the cathode is lifted away from the at least partly released metal deposits during the up and down motion in order to make more effective the up and down motion of the metal deposits.

9. Device for separating metal deposit from a mother plate used as a cathode in an electrolytic process, as metal electrorefining or metal electrowinning, in which device there is a supporting member for supporting the cathode to be treated, a member for releasing at least partly a metal deposit grown during the electrolytic process on a surface of the mother, the mother plate of a cathode providing with a growth affecting means for creating an irregularity in the growth of the metal deposit, and a member for supporting the released metal deposit, characterised in that the growth affecting means (16,24,36,43,53) is based on the density of electric current used in the electrolytic process on the edge (25,34,44) or on the vicinity of the edge of the mother plate of the cathode (1,21,31,41,51) opposite to the edge where the hanger bar is installed, and the growth affecting means (16,24,36,43,53) is used as a hinged member when the metal deposit (4) is tilted to the mother plate of the cathode (1,21,31,41,51) in order to break the metal deposit (4) in two separate pieces along the irregularity in the growth.

10. Device according to the claim 9, characterised in that the growth affecting means (1(6,24,36,43,53) is based on the length difference between the cathode and the respective anode in an electrolytic process.

* * * * *

UNITED STATES PATENT AND TRADEMARK OFFICE

CERTIFICATE OF CORRECTION

PATENT NO. : 6,632,333 B1
DATED : October 14, 2003
INVENTOR(S) : Ola Eriksson et al.

It is certified that error appears in the above-identified patent and that said Letters Patent is hereby corrected as shown below:

Title page,
Item [73], Assignee, should be corrected to read as follows:

-- Outokumpu Oyj, Espoo (FI)
Copper Refineries Pty Ltd, Queensland (AU)
Mesco Inc., Tokyo (JP) --

Signed and Sealed this

Tenth Day of February, 2004

JON W. DUDAS
*Acting Director of the United States Patent and Trademark Office*